US011873813B2

(12) United States Patent
Nguyen

(10) Patent No.: US 11,873,813 B2
(45) Date of Patent: Jan. 16, 2024

(54) SUCTION/COMPRESSION ROTATING MECHANISM, ROTARY COMPRESSOR AND ROTARY ENGINE

(71) Applicant: Hai Nguyen, Ha Noi (VN)

(72) Inventor: Hai Nguyen, Ha Noi (VN)

( * ) Notice: Subject to any disclaimer, the term of this patent is extended or adjusted under 35 U.S.C. 154(b) by 239 days.

(21) Appl. No.: 17/286,297

(22) PCT Filed: Jul. 8, 2019

(86) PCT No.: PCT/VN2019/000011
§ 371 (c)(1),
(2) Date: Apr. 16, 2021

(87) PCT Pub. No.: WO2020/082095
PCT Pub. Date: Apr. 23, 2020

(65) Prior Publication Data

US 2022/0196016 A1 Jun. 23, 2022

(30) Foreign Application Priority Data

Oct. 19, 2018 (VN) ..... 1-2018-04633

(51) Int. Cl.
*F04C 18/18* (2006.01)
*F04C 18/08* (2006.01)
(Continued)

(52) U.S. Cl.
CPC ..... *F04C 18/18* (2013.01); *F04C 2/16* (2013.01); *F04C 27/005* (2013.01); *F04C 2240/30* (2013.01)

(58) Field of Classification Search
CPC ..... F04C 18/18; F04C 18/082; F04C 18/084; F04C 27/005; F04C 2250/20; F04C 2/165;
(Continued)

(56) References Cited

U.S. PATENT DOCUMENTS 4,324,538 A 4/1982 Brown
4,430,050 A 2/1984 Blazejewski
(Continued)

FOREIGN PATENT DOCUMENTS

EP 1533526 A1 5/2005
EP 2927423 A1 10/2015
(Continued)

*Primary Examiner* — Deming Wan
(74) *Attorney, Agent, or Firm* — AEON Law, PLLC; Adam L. K. Philipp; David Cohen

(57) ABSTRACT

The present invention relates to highly efficient suction and compression rotating mechanisms, particularly the compression mechanism with piston blocks mounted on two axes and driven by a pair of matching gears in the field of compressors and vacuums or hydraulic system such as oil pump, hydraulic motor, hydraulic gearbox, specifically there is application that uses this mechanism to create one rotary motor with multi compression stages, force-generating stages and continuous fuel burning regime. The new rotary lobe structure in this invention provides a close contact between curved surfaces with the same radius, which is a "Surface-to-surface" contact, with much better tightness than "line" contact.

11 Claims, 12 Drawing Sheets

(51) Int. Cl.

| | |
|---|---|
| ***F04C 18/14*** | (2006.01) |
| ***F04C 11/00*** | (2006.01) |
| ***F04C 2/14*** | (2006.01) |
| ***F04C 2/16*** | (2006.01) |
| ***F04C 27/00*** | (2006.01) |

(58) Field of Classification Search
CPC .... F04C 2/16; F04C 2/14; F04C 18/16; F04C 18/14; F04C 18/086; F01C 1/084
See application file for complete search history.

(56) References Cited

U.S. PATENT DOCUMENTS

| | | | | |
|---|---|---|---|---|
| 4,813,388 | A | 3/1989 | Yang | |
| 2013/0089447 | A1* | 4/2013 | Yao | F03C 2/00 418/54 |
| 2014/0003987 | A1* | 1/2014 | Martin-Dye | F04C 2/086 418/9 |
| 2014/0010698 | A1* | 1/2014 | O'Connor | F04C 14/02 418/206.7 |

FOREIGN PATENT DOCUMENTS

| | | | |
|---|---|---|---|
| JP | 2002070776 | A | 3/2002 |
| JP | 2011064078 | A | 3/2011 |
| JP | 2011196247 | A5 | 10/2011 |
| WO | 0236939 | A1 | 5/2002 |

* cited by examiner

SUCTION/COMPRESSION ROTATING MECHANISM, ROTARY COMPRESSOR AND ROTARY ENGINE

RELATED APPLICATIONS

This application is a U.S. National Phase of, and claims priority to, PCT International Phase Application No. PCT/VN2019/000011, filed Jul. 8, 2019, which claims priority to a Vietnamese Patent Application No. VN1-2018-04633, filed Oct. 19, 2018. The entire contents of the above-referenced applications and of all priority documents referenced in the Application Data Sheet filed herewith are hereby incorporated by reference for all purposes.

TECHNICAL FIELD

The present invention relates to highly efficient suction and compression rotating mechanisms, particularly the compression mechanism with piston blocks mounted on two axes and driven by a pair of matching gears in the field of compressors and vacuums or hydraulic system such as oil pump, hydraulic motor, hydraulic gearbox, specifically there is application that uses this mechanism to create one rotary motor with multi compression stages, force-generating stages and continuous fuel burning regime.

BACKGROUND ART

Currently there are many compression or vacuum rotary mechanism in practical use such as screw compressors, vane pumps, rotary lobe blowers, centrifugal fans, etc. Each type has its own strengths and weaknesses. For example, two-lobed rotary air blowers with large flow, simple structure but low pressure because of poor sealing, screw compressors have a relatively high working pressure but normally must be sealed with oil so should be mounted with complex oil filter system, etc.

Current rotary lobe air compressors such as air blowers, screw air compressors, sealing positions between the rotating lobe or between the rotary lobe and the compression chamber shell are usually exposed in the form of "line" as the contact of two curved surfaces with different radius of curvature.

In general, rotary compressors or rotary vacuum have a simpler structure and higher flow than reciprocating types, but return-type compressors have difficulty in keeping its working chambers sealed because it is hard to create the absolute precision and to place the parts that sealed the gap between the rotating core and the chamber wall or amongst the rotating cores together.

Engines with force-generating translational motion mechanisms have the following weaknesses:

- There must be a mechanism that turn translational motion to rotary motion such as a connecting rod, crank shaft, etc. This complicate the structure of the reciprocating engine, high fabrication cost, engine is hard to maintain its dynamic balance, complex repair and maintenance mode.
- With the reciprocating motor, the intake air flow into the combustion chamber is not stable, in case of high speed rotation mode, the intake efficiency will be reduced by the inertia delay of the intake gas, and the ability of capacity increase is rapidly decreased in high speed rotation mode. If you want to increase the engine capacity, must use the booster system attached.

- Power loss on translational moving parts increases by the squared scale of the number of motor turns. Generating large dynamic loads acting on engine supports also follows the same ratio, reducing the life of the engine parts.

DISCLOSURE OF INVENTION

The purpose of this invention is to create a rotary compression mechanism with:

- Simple structure, easy to fabricate;
- Less leakage and high efficiency;
- Do not utilize lubricating oil or sealing oil;
- Full rotation balance;
- Large flow;
- Balance the forces generated by the internal pressure of the pump;
- Small friction;
- Easily increase engine power.

To achieve the above goal, this invention provides a rotary compression mechanism with rotary lobes (similar to air blowers), but has special structures to increase the tightness. The new rotary lobe structure in this invention provides a close contact between curved surfaces with the same radius, which is a "surface-to-surface" contact with much better tightness than "line" contact. Note that the word "contact" here is a symbolic representation, because in fact it is necessary to avoid the actual contact between the rotating lobes or between the rotating lobes with the compression chamber to eliminate friction during working, which can cause destruction of compressor parts, further creating space for thermal expansion of compressor parts during working process. The "surface-to-surface" contact in the sealing positions facilitates the installation of sealing parts at all gaps between the rotating core and the pump chamber or among the rotating parts. Meanwhile, the profile of the rotating core do not need to be fabricated accurately while still not affecting the tightness of the pump chamber.

However, the fact that the compression structure must be a solid structure, fully dynamic balance and simple fabrication, so the rotating lobe structure here is divided into two main parts:

- The main lobe. We can name it the rotating piston, as its sealing parts are all in the "surface-to-surface" form as in the reciprocating compressor piston. It is the main working part of the compression mechanism. These main rotary lobes are symmetrically mounted on both sides of the sub-lobes.
- The sub-lobes: It has the same structure as the rotary lobes in existing lobe compressors, the sealing position is in "line" contact. However, these sealing position are very small compared to all the sealing parts of the compression mechanism, so the sealing effect of the compression mechanism is higher than that of conventional rotary lobe mechanisms. Although this sub-lobes also partially engages in compression, its main use is to place the main rotary part and to drive the main lobes. This sub-lobes section is mounted directly on the drive shaft. Here we will call them bearing plates.

In order for high efficiency of the compressor, this invention also provides a special profile for the top face of the piston and the bearing plates. Both have the same basic profile and these profiles are changed to suit their different working requirements and will be discussed later.

This invention also refers to rotary engines with a similar fuel combustion and force-generation expansion mode to gas turbines based on a rotary compression structure. This engine cycle is similar to the gas turbine cycle, which is the the brayton cycle. The only difference with gas turbines is the operation of the gas in this place in the closed space, while the operation of the gas in the gas turbine is open space. The engine operates in a such mode that the intake air pressure is loaded by the pressure in the combustion chamber is much higher than the intake pressure of the automobile cycle engines. Thus, these rotary motors need more than one compression stage to achieve high load pressure and intake efficiency. There are two options for rotary motors using the new compression mechanism mentioned above. Both options work on the Brayton cycle.

BEST MODE FOR CARRYING OUT THE INVENTION

Figure 1A:
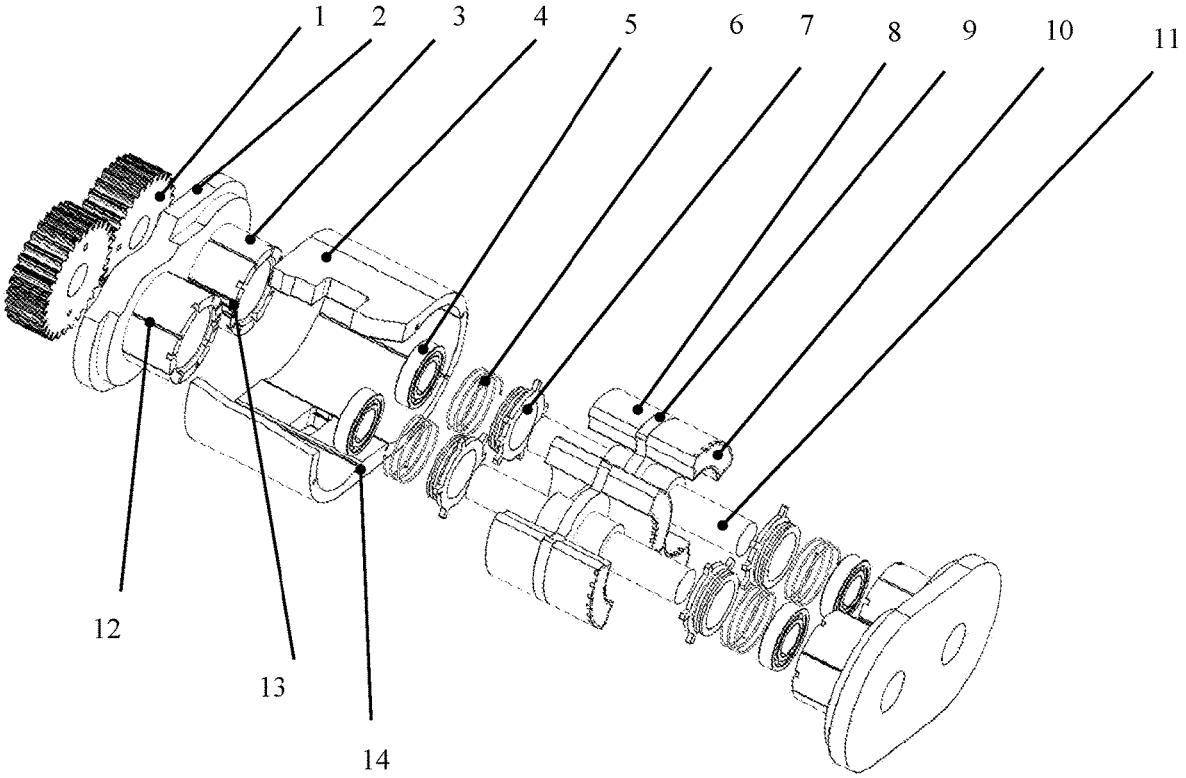
FIG. 1A is a perspective drawing showing an overview of the general structure and the main details of the compressor in a separate state.
Figure 1B:
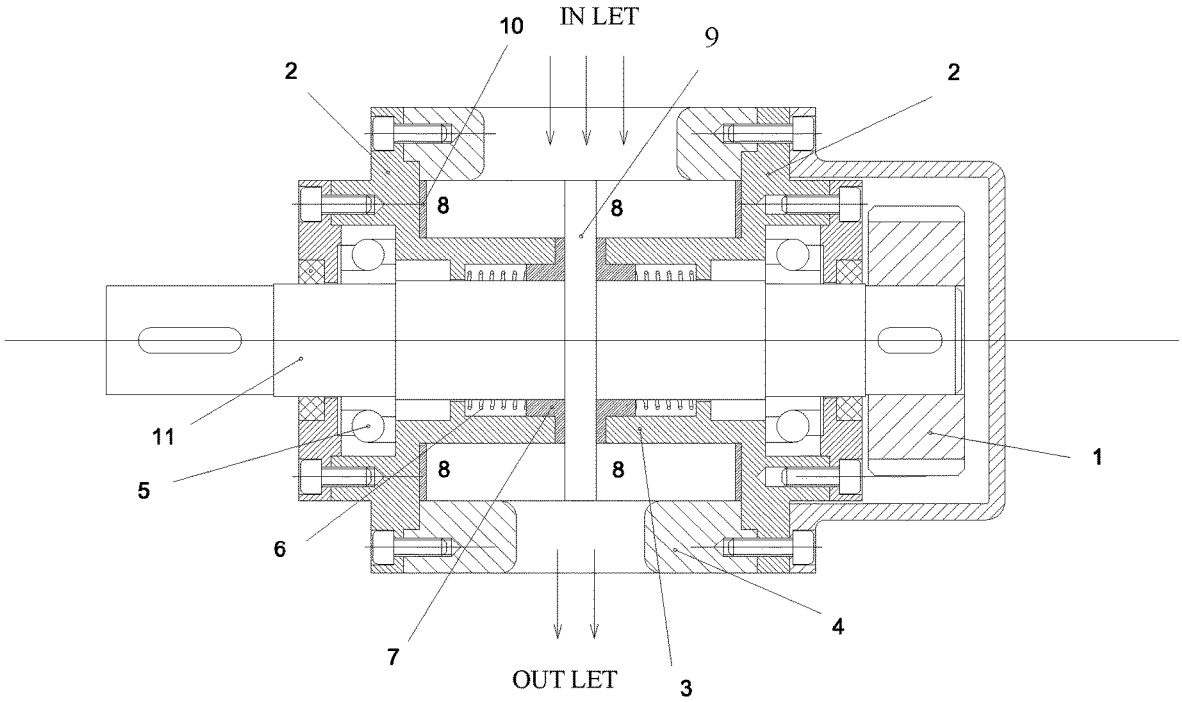
FIG. 1B is a longitudinal section showing details in the working position.

FIG. 1: Overview of the general structure and the main details of the compressor:

The pair of drive gears (1) is fastened on the two shafts (11), they drive the pistons to work together accordingly; The pump walls (2) and pump casing (4) are precisely assembled together thanks to the positioning brackets on the pump wall that forming the pump chamber; Ball bearings (5) are bearings that support axes, which are placed in cylinders (3) protruding from the pump wall (2); The springs (6) are also arranged in the cylinders (3) they always push the sealing rings (7) close to the side of the bearing plates (9) to seal the gap between the top face of the cylinders (3) and the side of the bearing plates (9);

The bearing plates (9) are fastened on the shaft (11) and the piston (8); The pistons (8) are symmetrically mounted on both sides of the plates (9) and symmetrically double through the center of rotation of the axes (11), which makes the whole block around the axes (11) balanced completely, while enhancing the bearing capacity of the whole unit during operation; The scanning bars (12) seal the gap between the inside of the piston (8) and the circumference of the cylinder (3);

Scanning bars (13) seal the gap between the concave surface of the cylinder (3) and the out side of the opposite piston (8); The scanning bars (14) seal the gap between the inside of the pump chamber (4) and the outside of the piston (8); Sealing plates (10) seal the gap between the side surfaces of the piston (8) and the pump walls.

Figure 2:
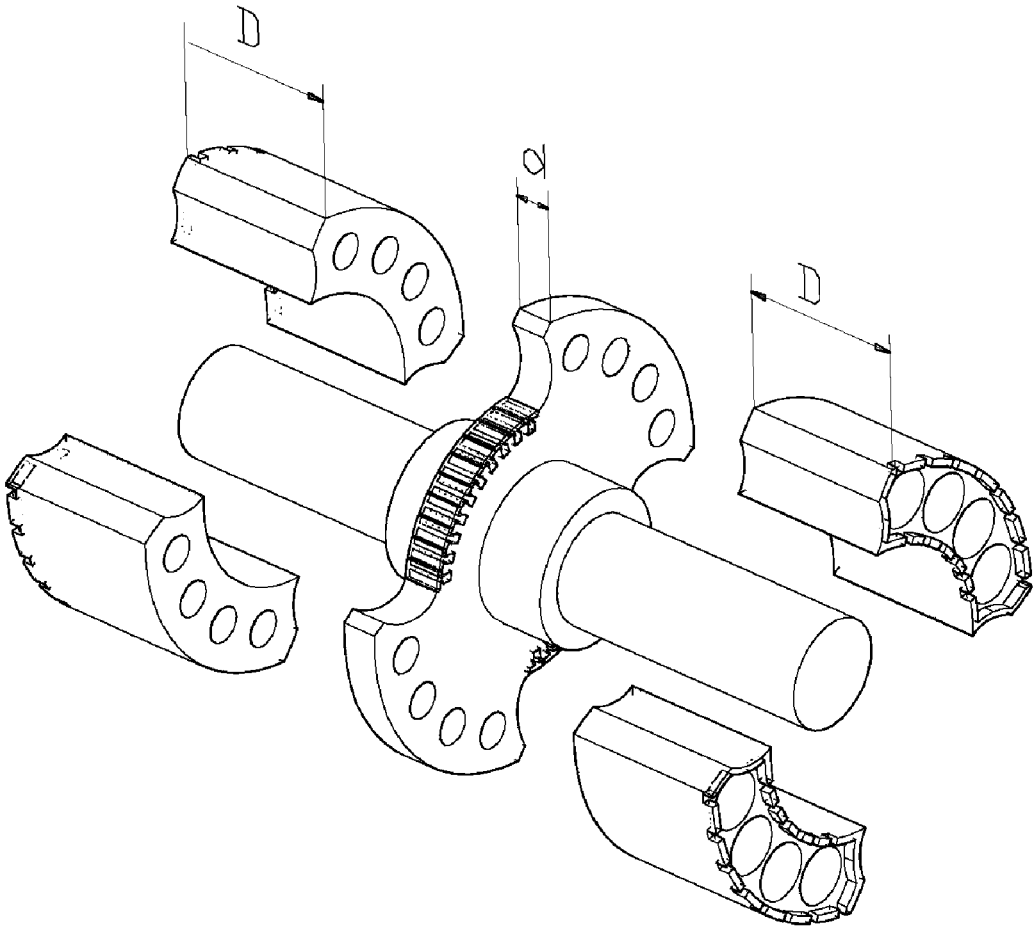
FIG. 2 is a perspective drawing of removable parts that show the comparison of the thickness of pistons and piston plates.

FIG. 2: The image of comparison the thickness of the piston and piston plates The thickness of the piston is D, the thickness of the bearing plate is d. The smaller the ratio of d/D, the better operation is, as long as it ensures the durability of the plate during operation of the pump.

Figure 3:
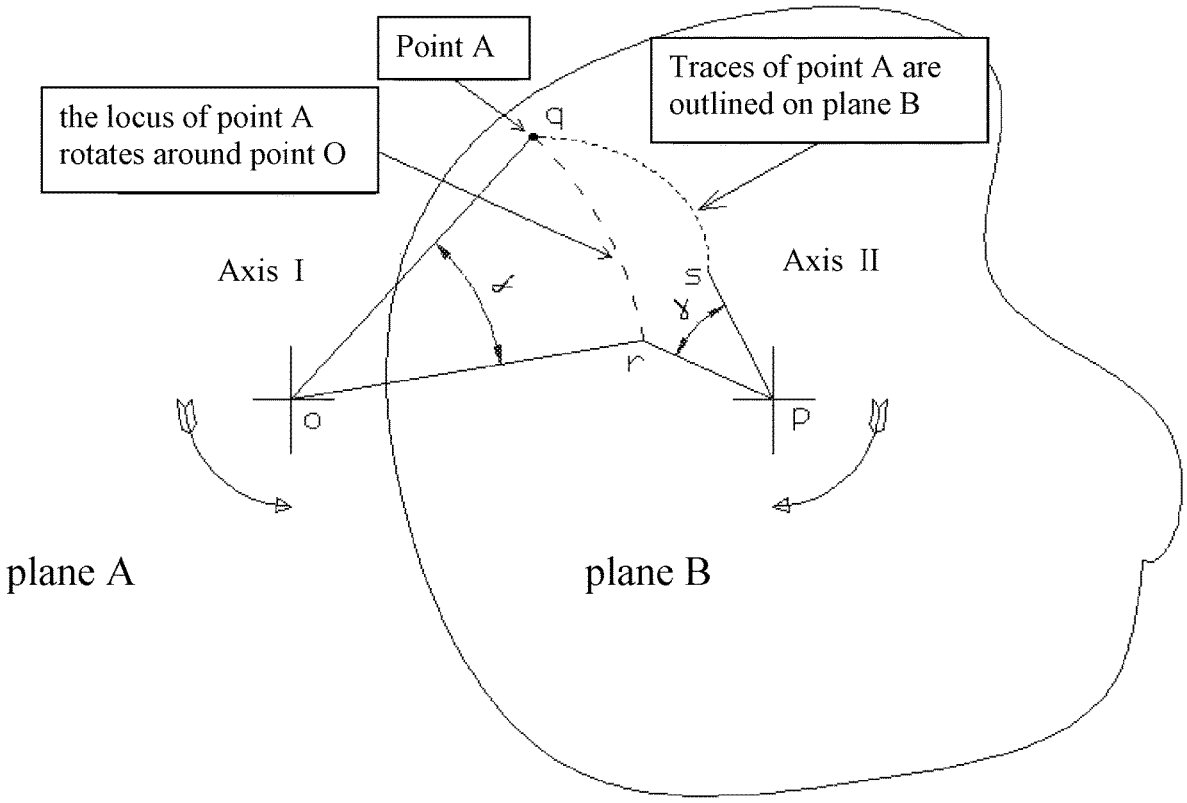
FIG. 3 is a schematic drawing showing how to create the baseline of piston profile and bearing plates.

FIG. 3: Base curve for creating profile of the piston top and bearing plate

Suppose we have 3 points A, o, p and plane B. Point A rotates around point o in a plane parallel to plane B and passes through two points o and p with a oq radius. Plane B rotates around point p with the same angular velocity as that of point A but in opposite direction. Point A will draw on the B-plane a curve, which is the base curve to create the profile of the piston top and the bearing plate.

(On the drawing: When point A rotates around point o with an angle $\alpha$, and plane B also rotates around point p at an angle $\alpha$ but in the opposite direction, then the projection of point A on plane B is the curve sq). The oq turning radius of point A will be the outer radius of the piston or radius of the bearing plate.

Figure 4:
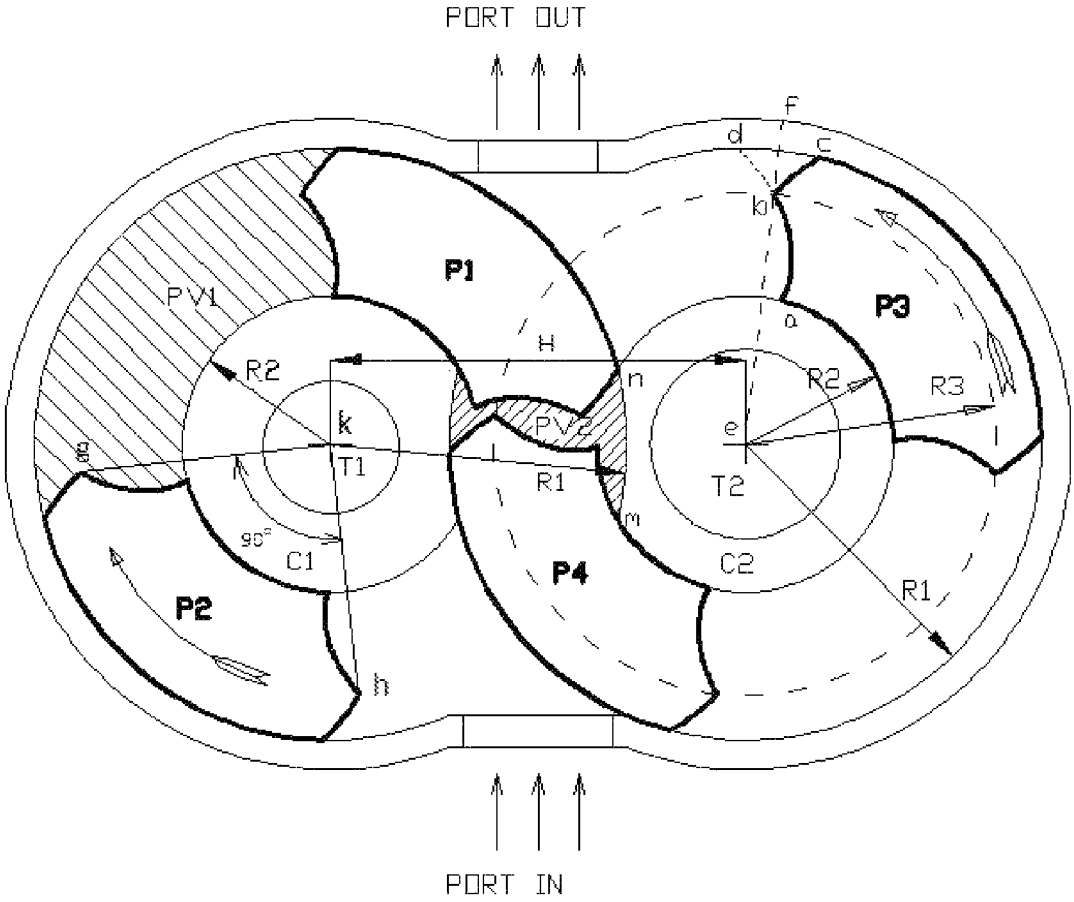
FIG. 4 is a schematic drawing showing the piston's boundary and the effects of basic parameters

FIG. 4: Describe how to create piston profile and basic parameters

Profile of piston top

In the above image, we have 4 symmetrical piston blocks in pairs, piston P1 is symmetrical with piston P2 through the axis T1, P3 piston is symmetrical with P4 piston block through axis T2. The piston blocks rotate in opposite directions in the space limited by compressor case and cylinders C1 and C2.

The profile of piston top consists of two curves ab and bc, where the curve ab is part of the base curve abd, which is the curve as mentioned in the previous section. The curve bc is the symmetry of the remaining bd part of the base curve through the straight line ef going through the center of rotation T2 and point b.

The profile of piston top consists of two curves ab and bc, where the curve ab is part of base curve abd, wick is the curve as mentioned in the previous section. The curve bc is the symmetry of the remaining bd part of the base curve through the straight line ef going through the center of rotation T2 and point b.

The profile at the other end of the piston is symmetrically aligned to the center of rotation so that the angle is creat by two vetices of the piston and the center of rotation is 90 degrees. The angle gkh will be 90 degrees.

With the piston lobe we always have $H<(R1+R2)$, this is the condition for the segment of the concave curve on cylinders C1 and C2 exists, i.e the length $mn>0$.

This new compression mechanism has added cylinders C1 and C2, which are mounted on the walls of the compressor chamber, having the center axis coinciding with the center of rotation of the piston blocks, the outer radius of the cylinders respectively with internal radius of piston blocks. These cylinders are concave cut by arc mn with radius corresponding to the outer radius of the piston blocks and the center of the arc mn coincides with the center of rotation of the opposite piston blocks. The length of cylinder is equal to the width of the piston blocks. This makes the sealing of fully piston blocks a "surface-to-surface" contact and the compressor's tightness significantly increased compared to existing rotary lobe compressors.

That mounting of symmetrical piston blocks on the bearing plate is for the entire rotary movement of the compressor to be fully balanced, the compressor can operate in high rotation mode, providing high durability and large flow of compressor.

Different ratios of dimensions R1, R2, and R3 and the distance H between two rotary center T1 and T2 will create compressors with different compression flow and compression ratios. PV1 slash section is the volume limited by out side and top side of piston P1, P2, cylinder and compressor case. The slash section PV2 is a volume that smaller than the limited by the curved surfaces mn on cylinders C1, C2 and top side of pistons P1, P4 at the time they form the closed space during rotation.

The profile of the piston top are not involved in sealing, ie the piston top of two pistons on the two axes do not need to touch each other, in fact the magnitude of the gap between them during the operation completely selected by the designer. The sealing is entirely dependent on the gap between the inside surface of the pump chamber, the piston body surface, the outer surface of the cylinder and the side surface of bearing plate. The profile of the piston top only works to optimize the compression ratio, increasing the efficiency of the compressor. This make the construction of the compressor simpler. The accurate when processing the profile of piston top and the profile of the bearing plate and the pair of drive gears that are not as strict as in other rotary lobe compressor.

Figure 5:
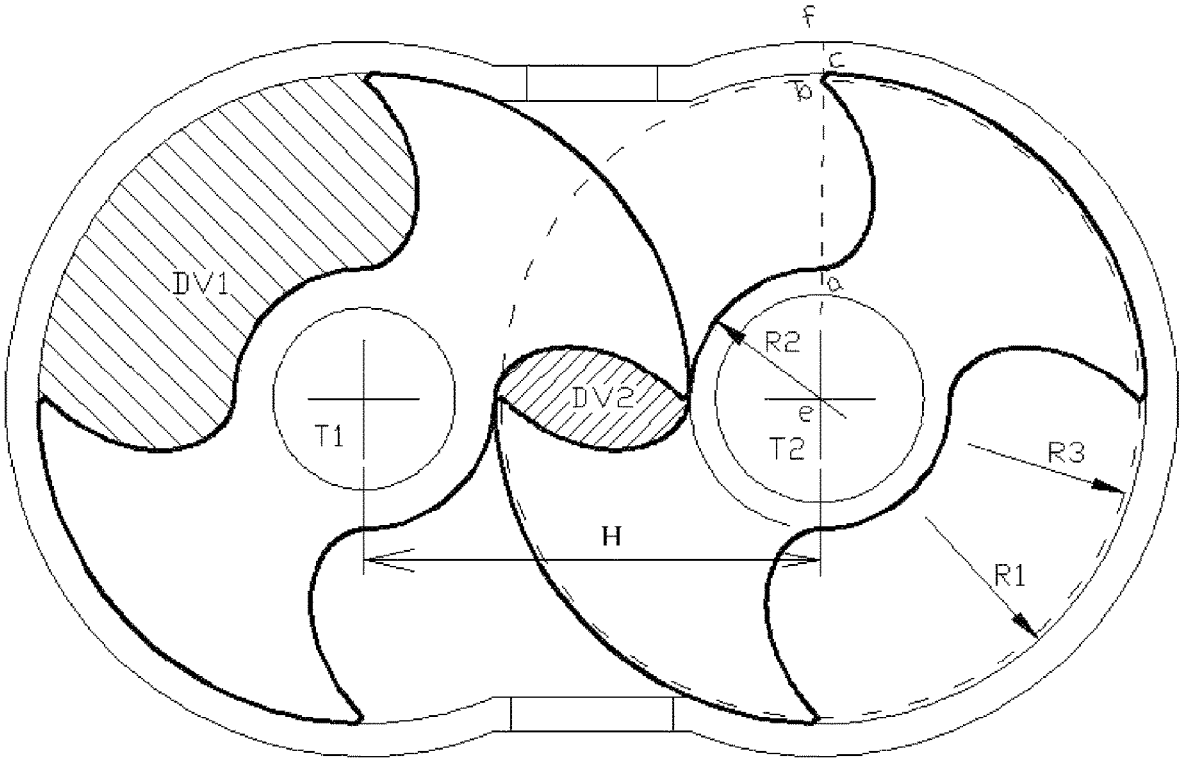
FIG. 5 is a schematic drawing showing the edge of the bearing plate and basic parameters.

FIG. 5: Describe the profile of the bearing plate and the basic parameters.

The bearing plate is a metal plate with its thickness much smaller than the thickness of the piston, the bearing plate is mounted on the rotating shaft of the compressor in the middle position of the compression chamber, located between the two ends of the cylinders C1 and C2. The front edge of the bearing plate is similar in structure to that of the piston head. but there is a much smaller curve bc, the curve bc on profile bearing place top is only the purpose to make "blunt" the sharp edge of the bearing plate. The R3 radius of the bearing plate can be considered approximately as the outer radius R1 of the bearing plate. The profile of the bearing plate is in fact a special case of the piston profile, when R1+R2=H, at this point the curve length mn=0.

DV1 is the volume fraction limited by a profile of the bearing plate, the compressor walls and the compressor case DV2 is the volume limited by two profile of the two bearing plates and the compressor walls when they form a closed space.

The main task of the bearing plate is to mount the piston blocks with the rotating shaft into a uniform rotating block, the bearing plate also participates in a very small part in compressing the like the rotary lobes of the compressors with the rotary lobe in the form of "line", however, because the bearing plate's thickness is very small compared to the thickness of the piston blocks, it does not much affect the tightness of the compressor.

The thickness of the bearing plate is only designed to be durable enough to avoid destruction during the compressor's working process. The piston blocks can be fabricated separately and then mounted on the bearing plate or can be monolithic fabricated with the bearing plate. The outer radius of the bearing plate is equal to the outer radius of the piston blocks, so the outer radius of whole block is R1, which makes the chamber shape of the compressor becoming simple cylindrical, quite similar to the machine chamber of conventional screw air compressors or lobe blowers, manufacturing is simple and nothing special.

Combining both piston and bearing plate, there are the following basic parameters:

Name the compression ratio of the compressor is $E$:

$$E=(PV1+DV1)/(PV2+DV2)$$

Name the flow of the compressor is $V$: $V=4\ (PV1+DV1)*\text{spin speed}$.

Because the thickness of the bearing plate is small compared to the thickness of the piston block, the compression ratio of the compressor is mainly the result of the ratio between PV1 and PV2.

The ratios of R1, R2, R3 and H generate different compressions and compression ratios of compressors, when the designed flow increases, the compression ratio decreases and vice versa.

The distance between two H-axes may fluctuate in the range of:

$$H=1.35R1 \text{ to } 1.75R1$$

The internal radius of piston R2 may fluctuate in the range of:

$$R2=0.45R1 \text{ to } 0.8R1$$

Radius R3 divides the profile of piston top in the range of:

$$R3=R2+0.5(R1-R2)$$

$$\text{to } R3=R2+0.6(R1-R2)$$

E compression ratio will be: E=6 to 30

In which R1 is the outer radius of the piston.

If all sealing parts of the pump are made of suitable materials, such as with low friction, abrasion resistance, heat resistance, the compressor will not need oil to lubricate or to seal.

Figure 6:
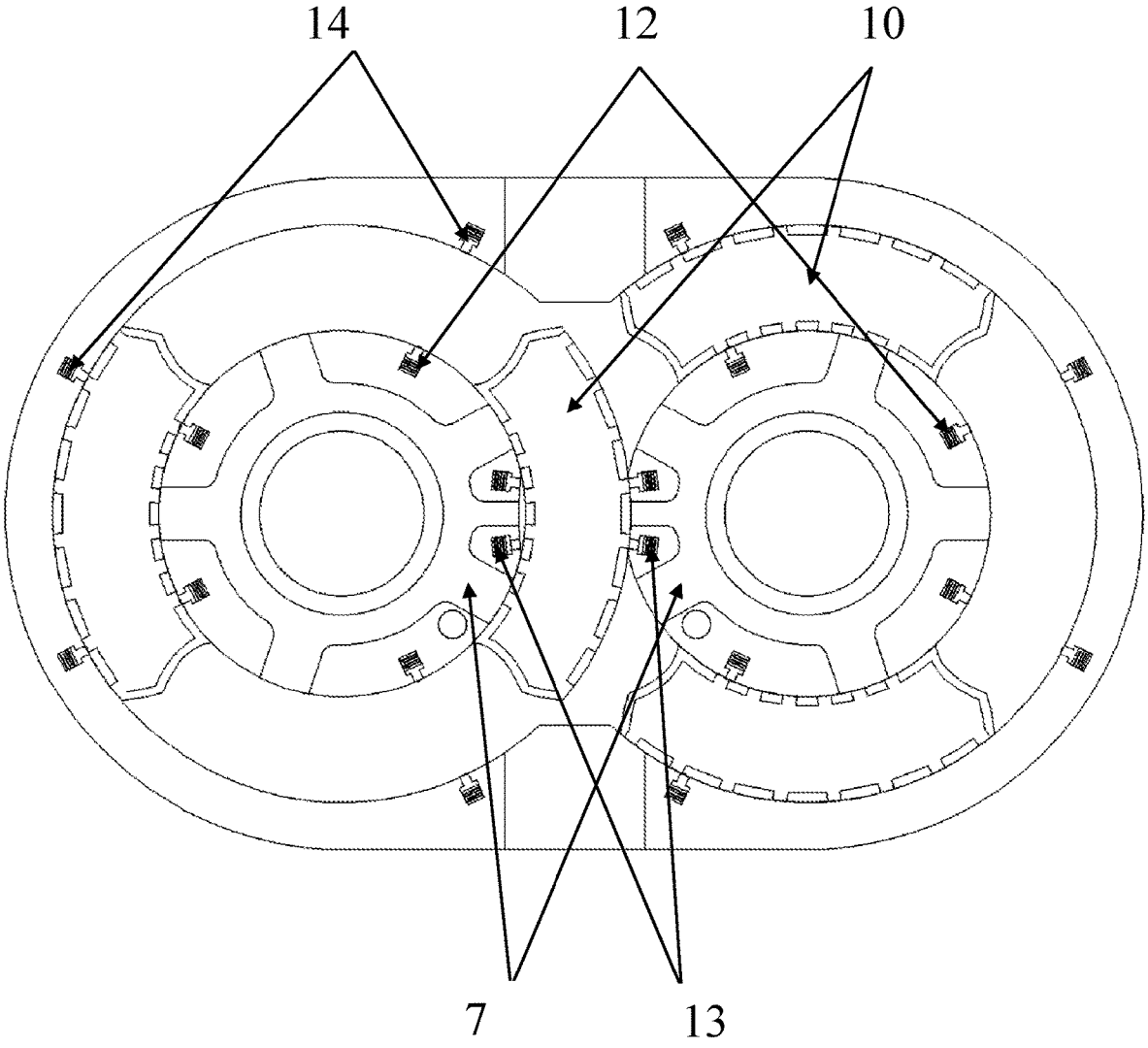
FIG. 6 is a sectional view showing the locations where sealing bars can be installed.

FIG. 6: The locations where sealing bars can be installed:

The scanning bars (14) are placed on the pump case to seal the gap between the outside of the piston and the inner wall of the pump case; The scanning bars (12) are placed on the cylinder (H1.3) to seal the gap between the inside of the piston and the outside of the cylinder (H1.3); Sealing plates (10) mounted on pistons to seal the gap between piston's side and the pump wall (H1.2); The sealing plates (7) are mounted on the ends of the cylinders to seal the gap between the cylinder's top (H1.3) with side surface of bearing plates (H1.9); The scanning bars (13) are mounted on the cylinders (H1.3) to seal the concave surfaces of cylinder (H1.3) and the outside of the piston on the opposite side.

Figure 7:
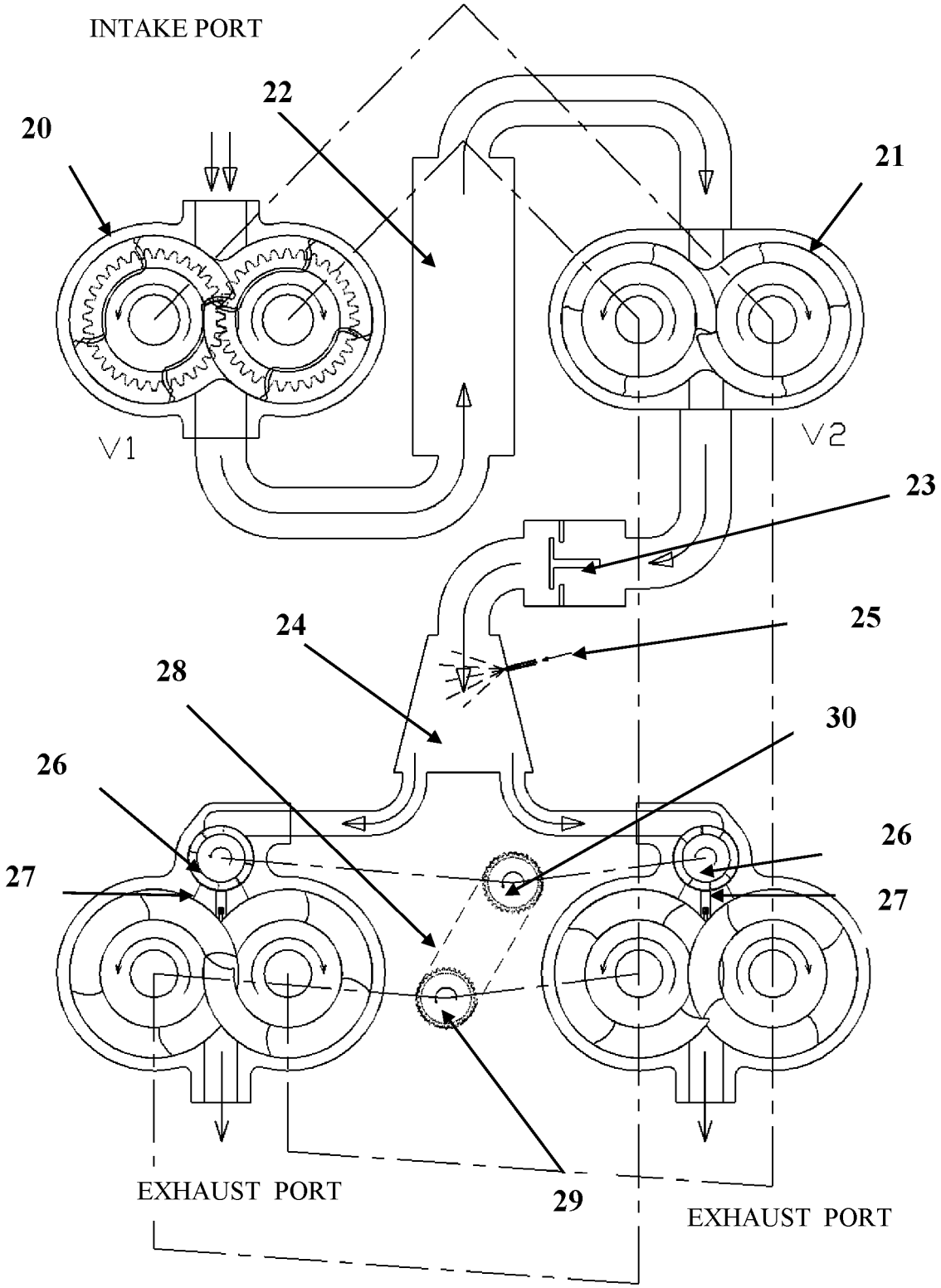
FIG. 7 is a schematic diagram of the engine principle according to option 1

FIG. 7: Diagram of the engine operation principle according to option 1:

Air passes through the inlet of the primary compressor (20). After primary air compression is fed into a gas tank (22) and continues into the secondary compressor (21). The high pressure air passes through the one-way valve (23) to the combustion chamber (23). Here the fuel is sprayed through a nozzle (25) of high pressure mixed with compressed air and in the combustion chamber (24). The burning gas is directed into the force-generating stage. When the rotary gas distribution valve (26) open the inlet compartments (27) and closes the cavity at the top of piston, the burning gas passing through into the compartments (27). When the rotary gas distribution valve (26) closes the inlet compartments (27) and open the cavity at the piston top open through with the compartment (27) the hot air will expand and generate energy.

The rotary gas distribution valve (26) is driven according to the rotation speed of the motor shaft so that the process of air distribution and expansion is smooth.

There are 4 pistons on each force-generating stages, so on one rotation of a compression floor there will be 4 expansion processes of combustion gas.

The ratio of the cavity (27) on a piston expansion volume can reach 1:25 or more, thus taking advantage of the expansion energy of combustion gas, enhance the efficiency of the engine.

Compression stages and the force-generating stages are driven by a pair of gears through two active axes. The rotary gas distribution valve (26) are driven by belt gear pairs (29) and (30), which rotate at the same speed with the engine axes.

The principle diagram here shows that the engine has two sequential compression stages and two parallel force-generating stages, the number of compression or force-generating floors may be more or less depending on the purpose or actual requirements.

Figure 8A:
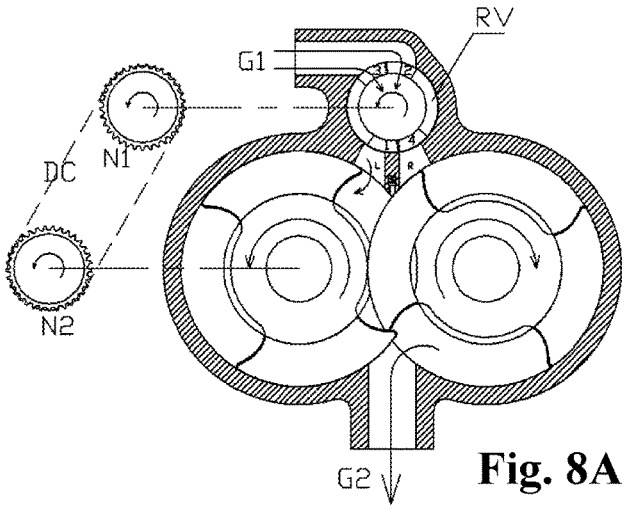
FIGS. 8A-8H are schematic drawings showing the engine's operating stages according to option 1.

FIGS. 8A-8H: Description of the engine operation stages according to option 1:

FIG. 8A: Rotary valve (RV) is a hollow tube with gate inlets and outlets; The belt wheel (N2) is attached to the drive shaft, through the toothed belt or chain to transmits to the belt wheel (N1) as the air valve (RV) rotating with the same speed of the motor shaft; On each rotary valve (RV) there are 4 gas gates for one force-generating stage: gates 1, 2, 3 and 4; Doors 1 and 2 are staggered with gate 3 and gate 4 along the valve; The compartments (L) and (R) are also placed alternately in the following order: gate 1 and gate 2 are placed corresponding to the cavity (R), gate 3 and gate 4 are set corresponding to the cavity (L); The burning gas under high pressure is passing through the pipe (G1) passing through doors 2 and 3 into the rotary valve (RV); The burning gas begins to under high pressure is passing through the pipe (G1) passing through doors 2 and 3 into the rotary valve (RV); The burning gas begins to expand from the cavity (L) into the piston chamber on the left; The exhaust gas passes through the exhaust gate (G2).

Figure 8B:
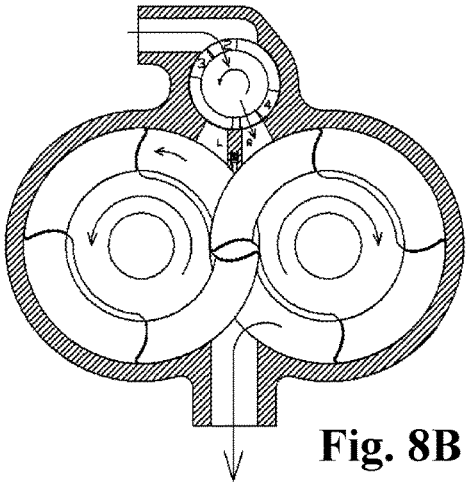

FIG. 8B: burning gas from inside the valve (RV) through gate 1 into the cavity (R); The expansion process continues on the left piston chamber; burning gas is still going through gate 2 into the valve (RV).

Figure 8C:
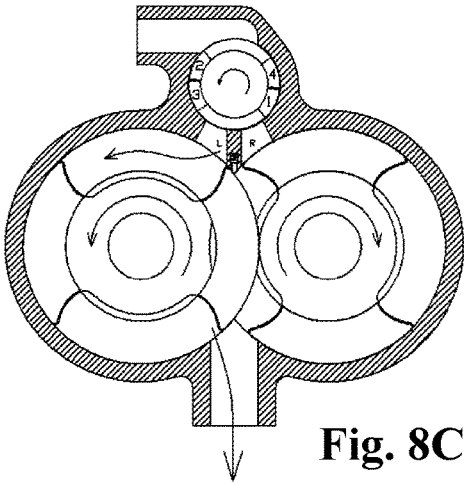

FIG. 8C: the expansion of the piston chamber on the left ends; The process of filling high pressure air into the cavity (R) ends.

Figure 8D:
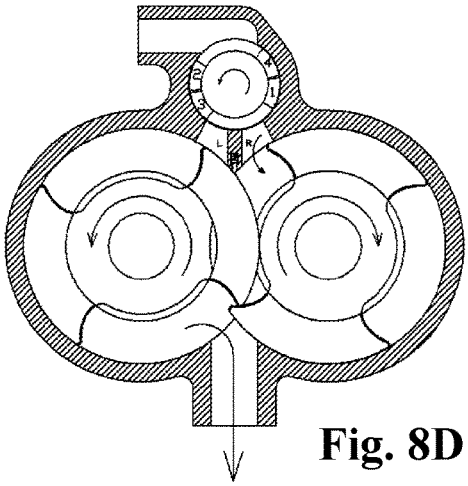

FIG. 8D: burning gas from the cavity (R) begins to expand into the right piston chamber.

Figure 8E:
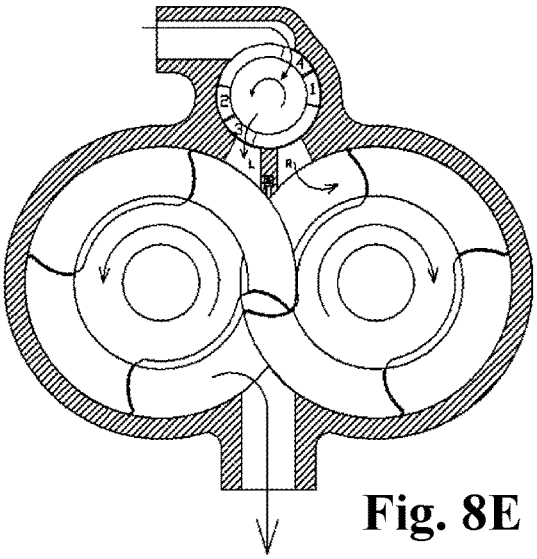

FIG. 8E: Burning gas go through door 4 into the rotary valve (RV); Burning gas enters the cavity (L) through gate 3; The process of expansion on the right piston chamber is continuing.

Figure 8F:
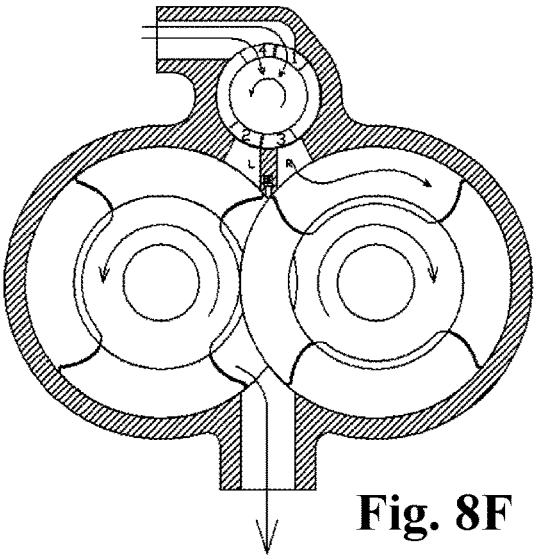

FIG. 8F: Burning gas flows into the rotary valve (RV) through both gates 4 and 1; The process of expansion on the right piston chamber ends.

Figure 8G:
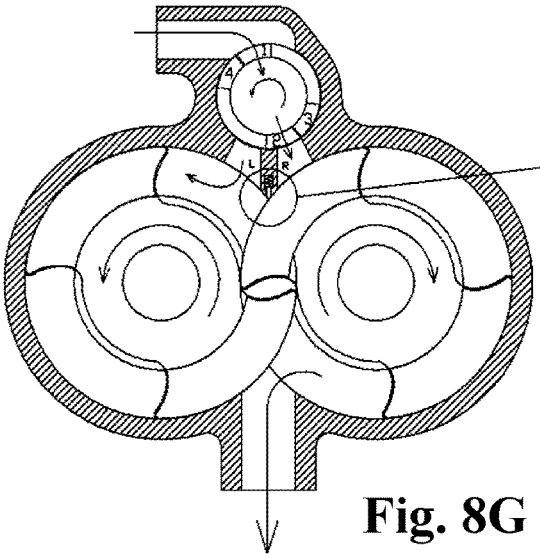

FIG. 8G: Burning gas continues into the rotary valve (RV) through door 1; Burning gas from the cavity (L) is expanding into the left piston chamber; Burning gas go into cavity (R) through gate 2.

Figure 8H:
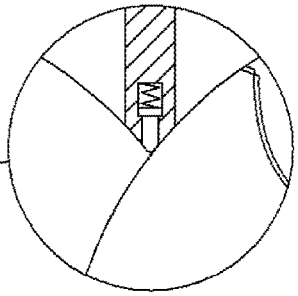

FIG. 8H: Sealing parts between the left piston and the right piston.

The piston assemblies at the force-generating floors on the same axis are arranged to rotate evenly around the axis for the purpose of creating a smooth torque for the engine. Therefore the combustion gas mixture from the combustion chamber is always continuously loaded into the rotary valves at all times.

When the air supply valve is closed, it will allow the expansion air into the piston chamber, so if the volume of these closed chambers is of sufficient size, the engine will be able to maximize the energy of the hot gas with expansion pressure that come close to the pressure of the environment. The engine will achieve high efficiency.

The motor has all the details that are symmetrical and fully rotated, there are no reciprocating movements so the engine is perfectly rotating balanced.

The engine uses continuous fuel combustion so the engine can use a variety types of fuels.

The engine is easily seal between the parts moving relative to each other by sealing parts.

Figure 9:
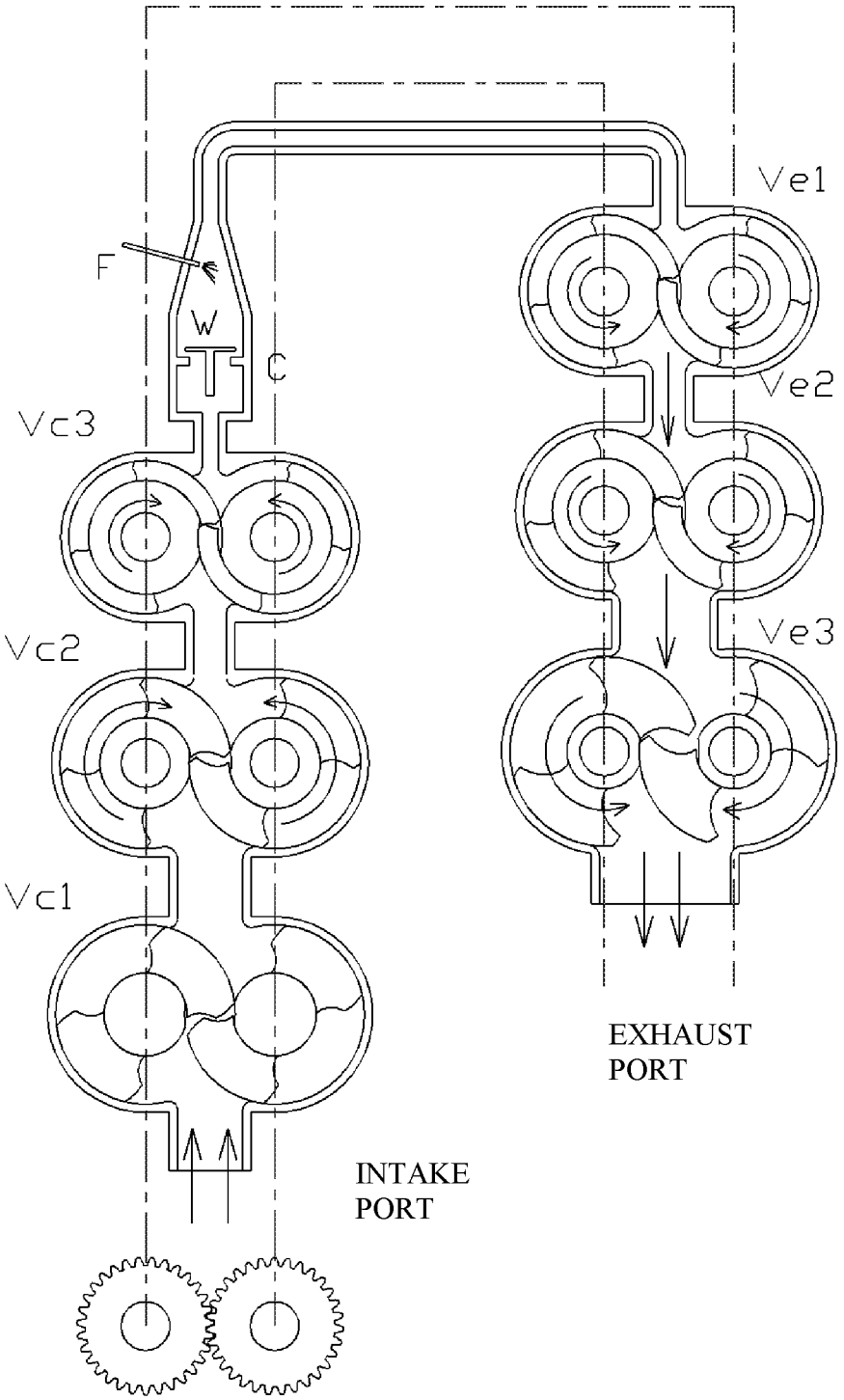
FIG. 9 is a schematic drawing showing the engine operation principle according to option 2.

FIG. 9: Diagram of the engine operation principle according to option 2:

The air is compressed through a number of sequential compression stages, which are compressed stages (Vc1), (Vc2) and (Vc3); The compressed air with high pressure passes through the one-way valve (W) into the combustion chamber (C); Fuel is sprayed into the combustion chamber (C) through the nozzle (F) mixed with air and burned; Burning gas expand through a number of force-generating sequential stages, there are the force-generating stage (Ve1), (Ve2) and (Ve3); The working volume of these stages increases with the direction of the expanding gas.

Figure 10:
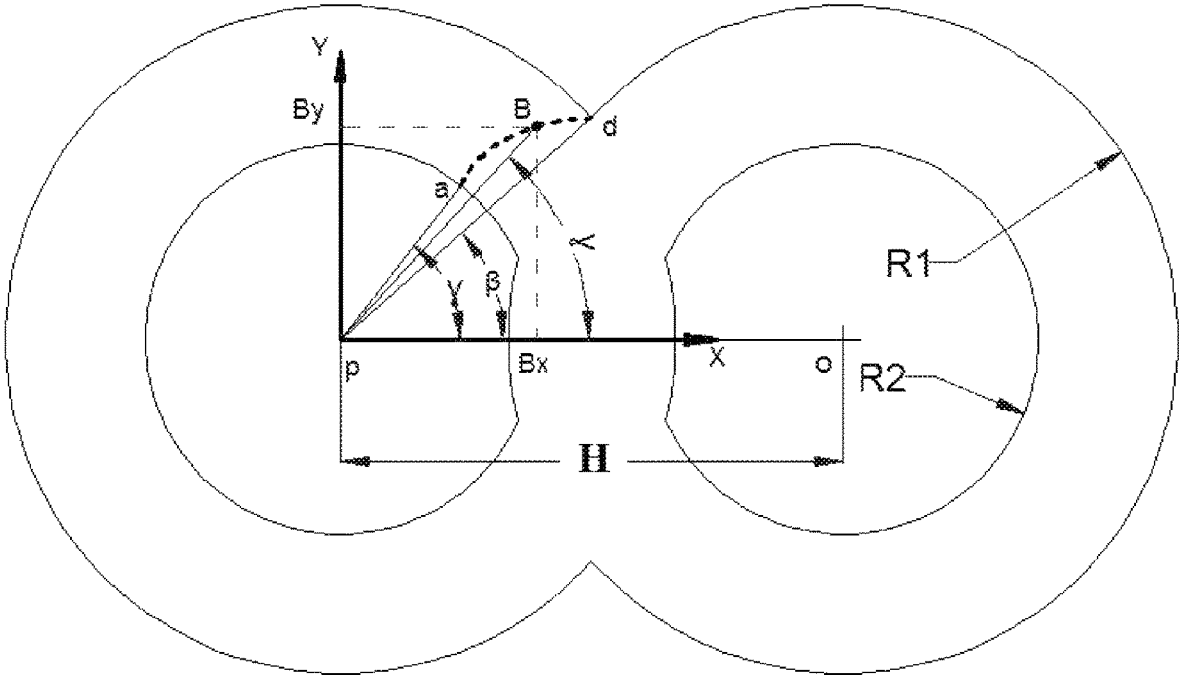
FIG. 10 is a diagram showing the main profile trajectory of the piston and piston plate.

FIG. 10: The trajectory of the base curve

The equation for calculating the trajectory of the base curve is:

$$Bx=H\cdot\cos(\alpha-\beta)-R1\cdot\cos(3\beta-2\alpha)$$

$$By=H\cdot\sin(\alpha-\beta)+R1\cdot\sin(3\beta-2\alpha)$$

In which:

Angle opd=β

Angle opa=γ

Angle opb=α

(α is the variable angle when point B runs on the base curve, α has the initial value is β when point B coincides with point d, and the final value is γ when point B coincides with point a).

R1 is the outer radius of the piston.

R2 is the inner radius of the piston.

H is the distance between two shaft

The base curve is the curve ad.

The invention claimed is:

1. A rotary suction/compression mechanism includes:

a chamber formed by a casing around two symmetrical parallel overlapping cylindrical spaces bounded by opposite end walls;

two shafts located at center-lines of the two cylindrical spaces, driven by a pair of matching gears affixed to the shafts;

two bearing plates fastened on the two shafts and located in a middle of the chamber between the end walls, each of the bearing plates having sides facing the end walls and a diameter approximately equal to an inner diameter of the cylindrical spaces of the pump chamber casing;

fixed hollow cylinders protruding from each of the end walls around each of the shafts, entering the cylindrical spaces between the end walls and the bearing plates, wherein tops of the cylinders are close to side surfaces of the bearing plates, center-lines of the cylinders coincide with the center-lines of the shafts, and outer diameters of the cylinders are less than the inner diameter of the cylindrical spaces of the chamber casing, leaving room between the cylinders and the chamber casing;

the pistons mounted in pairs symmetrically on opposite sides of each of the bearing plates and in pairs symmetrically across the centerline of each of the shafts, wherein the outer diameters of the pistons are approximately equal to the diameter of the bearing plate and the inner diameter of the cylindrical spaces of the chamber casing, the inner diameters of the pistons are approximately equal to the outer diameter of the cylinders protruding from the end walls, and the pistons are arranged such that when operating, the pistons on both sides of the bearing plates will rotate around the two pump shafts in the room between cylinders and the chamber casing;

wherein heights of the pistons are approximately equal to corresponding heights of the cylinders and the thicknesses of the pistons fill the room between the cylinders and the chamber casing, such that sealing of the pistons is by surface-to-surface contact.

2. The rotary suction/compression mechanism in accordance with claim 1, further comprising one or more of:

chamber scanning bars placed on or in an inside of the chamber casing to seal a gap between an outside surface of the pistons and an inside surface of the chamber casing;

outer cylinder scanning bars placed around a circumference of each cylinder to seal a gap between an outer surface of the cylinder and an inner surface of the pistons on the cylinder's shaft;

cylinder sealing rings at the tops of the cylinders to seal a gap between a top face of the cylinder and the side surface of the bearing plate;

piston end seals to seal a gap between end surfaces of the pistons and the end walls;

bearing plate seals placed around sections of each bearing plate to seal a gap between a small diameter section of the bearing plate on one shaft with a large diameter portion of the other bearing plate on the other shaft.

3. An air compressor including the rotary suction/compression mechanism in accordance with claim 1, wherein the rotary suction/compression mechanism operates in a compression mode.

4. A rotary motor comprising a plurality of suction/compression mechanisms in accordance with claim 1 including a number of successive compression stages with first rotary suction/compression mechanisms operating in a compression mode to produce high pressure compressed air, which is then mixed with fuel and combusted in a combustion chamber located outside of force-generating stages with second rotary suction/compression mechanisms operating in an engine mode where the combusted air expands to generate force.

5. The rotary motor rotates in accordance with claim 4, wherein the fuel mixture after being combusted is divided into closed chambers with rotating air valves, and directed to the second rotary suction/compression devices in a parallel arrangement.

6. The rotary motor in accordance with claim 4, in which the fuel gas mixture after being combusted is expanded directly into the second rotary suction/compression mechanisms in a serial arrangement.

7. The rotary suction/compression mechanism of claim 1, wherein a distance H between the centerlines of the shafts is less than a sum of an outer radius of the pistons R1 on one shaft plus an outer radius of the cylinders R2 around the other shaft; and wherein, in a side of each cylinder facing the other shaft, a concave arc is cut with a radius equal to the outer radius of the pistons R1 on the other shaft and a center that coincides with the centerline of the other shaft.

8. The rotary suction/compression mechanism of claim 7, wherein a profile of a top of the pistons includes a first curve created by tracing a path of a point rotating in a plane at an angular velocity around a fixed first axis at the radius R1 while the plane on which the path is traced rotates at the same angular velocity but in the opposite direction around a fixed second axis the distance H away.

9. The rotary suction/compression mechanism of claim 8, wherein the profile of the top of the pistons further includes a second curve that is a reflection of the first curve around a limiting radius from the second axis that intersects the first curve, wherein the limiting radius limits an angular width of the piston to ninety degrees or less.

10. The rotary suction/compression mechanism of claim 7, further comprising concave are scanning bars placed on or in a concave are outer surface of each of the cylinders to seal a gap between the concave are outer surface of the cylinder and outside surfaces of the pistons on the opposite shaft.

11. The rotary suction/compression mechanism of claim 1, wherein the sealing of the pistons by surface-to-surface contact increases achievable compression compared to conventional rotary lobed compressors.

* * * * *